United States Patent [19]

Crossley et al.

[11] 4,069,113

[45] Jan. 17, 1978

[54] ELECTROPLATING GOLD ALLOYS AND ELECTROLYTES THEREFOR

[75] Inventors: John Alan Crossley, Oswestry, England; Valerie Kathryn Hacker nee Weimer, Chirk near Wrexham, Wales; Paul Grahame Clorley, Telford New Town, England

[73] Assignee: Oxy Metal Industries Corporation, Warren, Mich.

[21] Appl. No.: 380,804

[22] Filed: July 19, 1973

[30] Foreign Application Priority Data

July 26, 1972 United Kingdom ..... 34972/72

[51] Int. Cl.[2] ..... C25D 3/62

[52] U.S. Cl. ..... 204/43 G

[58] Field of Search ..... 204/43 G, 46 G, 44

[56] References Cited

U.S. PATENT DOCUMENTS

| | | | |
|---|---|---|---|
| 2,967,135 | 1/1961 | Ostrow et al. | 204/43 G |
| 3,367,853 | 2/1968 | Schumpelt | 204/46 G |
| 3,475,290 | 10/1969 | Yamamura et al. | 204/43 G |
| 3,562,120 | 2/1971 | Duva et al. | 204/46 G |

FOREIGN PATENT DOCUMENTS

| | | | |
|---|---|---|---|
| 897,463 | 5/1962 | United Kingdom | 204/46 G |
| 234,813 | 4/1969 | U.S.S.R. | 204/46 G |

*Primary Examiner*—G. L. Kaplan

*Attorney, Agent, or Firm*—B. F. Claeboe; Richard P. Mueller; Arthur E. Kluegel

[57] ABSTRACT

Disclosed is an electrolyte for the deposition of predominantly gold alloy deposits, a method for the preparation and use of the electrolyte, and an article obtained by such electrodeposition. These electrolytes contain soluble gold and base metal salts, a buffer system effective at pH 4-6, and either a soluble aluminum compound or formate or oxalate ions. Preferably, the electrolyte contains both the aluminum and formate or oxalate ions.

14 Claims, No Drawings

ELECTROPLATING GOLD ALLOYS AND ELECTROLYTES THEREFOR

The present invention relates to the plating of articles with noble metal, e.g. gold, compositions and discloses a novel plating bath composition and method of electroplating using such a bath composition.

The invention has been developed with the particular problems of printed circuit boards and their connectors, e.g. spring connectors, in mind where a high resistance to wear is required. Thus the thin metal electrical contacts on the boards have to tolerate repeated formation and breaking whilst maintaining very demanding electrical performance characteristics, e.g. corrosion resistance, low porosity, and good resistance to wear.

It will be appreciated however that the invention is also applicable to plating articles in general e.g. for both decorative and functional purposes.

The invention is particularly concerned with cyanide based acidic gold bath compositions. These are known for example from U.S. Pat. No. 29050601. This discloses the use of potassium aurocyanide solutions, e.g. at 1 to 15 grams per liter of gold concentration, dissolved in a citric acid/sodium citrate buffer system, e.g. 10 to 150 grams per liter of citric acid, with a soluble base metal salt, e.g. a sulphate, sulphamate, formate, acetate, citrate, lactate, tartrate, fluoborate, borate or phosphate of nickel, zinc, cobalt, indium, iron, manganese, antimony, or copper, e.g. at a concentration of 1 to 50 grams per liter.

These systems produce bright, hard wear resistant deposits but at relatively low efficiency e.g. about 30% (say 45 mg/amp. min. using an 8 gram per liter gold solution; 100% efficiency would be 120 mg/amp. min.) using pHs of 3 to 4 when the base metal is cobalt.

We have found that if one attempts to increase the efficiency of the process by operating at a higher pH one finds that the deposit loses brightness. If one decreases the pH the brightness increases but the efficiency drops, other variables remaining constant; and if one increases the cobalt concentration in the solution the pH at which the conflicting effects balance merely moves up to a higher value and no increase in efficiency without loss of brightness or increase in brightness without loss of efficiency is achievable.

An object of the present invention is the provision of a process of improved efficiency without loss of brightness or significant reduction in wear resistance. The present invention is based on the discovery that if formic acid and aluminium in the form of an alkali metal aluminate are added to a gold aurocyanide solution buffered with a citric acid/citrate buffer containing soluble cobalt excellent bright wear resistant electrodeposits can be produced at much increased efficiency.

Thus according to the present invention an electrolyte solution for use in the electrodeposition of gold which comprises:

a. gold, in the form of a soluble salt, preferably potassium aurocyanide, though sodium or ammonium salts could be used, preferably at a concentration of 1 to 32 e.g. 6 to 12 and preferably 8 grams per liter of gold, b. a base metal in the form of a soluble salt, preferably cobalt or nickel since these can be co-deposited with gold, from which the base metal can be electrodeposited, e.g. a sulphate e.g. cobalt sulphate $CoSO_4.7H_2O$, though the base metal could be in the form of a chelate of suitable instability constant, the base metal preferably being at a concentration of 0.1 to 20, e.g. 1.0 to 10 or 1.25 to 3.00, preferably 1.5, grams per liter of base metal, c. a compatible buffer system effective to produce a pH of 4 to 6 e.g. 4.5 to 5.5 and a density of 1 to 32, e.g. 8 to 30, or 10 to 20 and preferably 15°, Baume, d. aluminium in the form of a soluble salt, e.g. potassium aluminate, preferably at a concentration of 0.01 to 2, e.g. 0.05 to 1 e.g. 0.1 to 0.5 or preferably 0.15 to 0.30 e.g. 0.2, grams per liter, and/or, e. formate ions, preferably 1 to 250, e.g. 5 to 100 or 12 to 45 e.g. 18 to 30 or preferably 25, grams per liter. Formic acid has a density of 1.22 and thus on a volume basis the formic acid is preferably added as 1 to 100, e.g. 10 or 20 to 35 or 40, 15 to 25 or preferably 20, milliliters per liter.

Whilst formic acid is preferred it may be replaced by oxalic acid.

Any suitable buffer system could be used e.g. one based on sulphates, pyrophosphates, orthophosphates, sulphamates or gluconates. However, a citric acid/citrate system has been found satisfactory and is preferred. The buffer system may thus comprise 30–80, e.g. 50 to 60 and preferably 50, grams per liter of citric acid and 100 to 160, e.g. 120 to 150 and preferably 135, grams per liter of an alkali metal salt of citric acid, e.g. tripotassium citrate. Any suitable compatible base can be used to adjust pH but potassium hydroxide is preferred.

As mentioned above the bath can also contain chelating agents e.g. polyamino-, imino-, or nitrilopolycarboxylic acids and their, preferably alkali metal, salts, e.g. ethylenediaminetetraacetic acid (as the disodium salt), nitrilotriacetic acid, hydroxyethylenediaminetriacetic acid, diethylenetriaminepentaacetic acid, cyclohexanediaminetetraacetic acid and aminodiacetic acid.

The preferred optimum proportions are 8 g.p.l. of gold, 1.5 grams per liter of cobalt, 0.2 grams per liter of aluminium, 20 milliliters per liter of formic acid. This contains 0.04 gram atoms of gold, 0.007 gram atoms of aluminium, 0.025 gram atoms of cobalt and 0.54 grams ions of formate, all per liter.

Thus the ratio of noble metal (N) to base metal (B) is 1.6:1;
the ratio of noble metal (N) to aluminium (A) is 5.5:1;
the ratio of base metal (B) to aluminium (A) is 3.4:1;
the ratio of noble metal (N) to formate (F) is 0.075:1;
the ratio of aluminium (A) to formate (F) is 0.0014:1;
the ratio of base metal (B) to formate (F) is 0.047:1 in this preferred formulation.

More broadly N/B may be in the range 7.0:1 e.g. 3.5:1 to 0.15:1, e.g. 2:1 to 1:1;
N/A may be in the range 30:1 to 1:1, e.g. 10:1 to 3:1 or 6:1 to 5:1;
B/A may be in the range 35:1 to 0.5:1, e.g. 7:1 to 1:1 or 4:1 to 3:1;
N/F may be in the range 0.01:1 to 0.2:1, e.g. 0.05:1 to 0.1:1;
A/F may be in the range 0.0005:1 to 0.2:1, e.g. 0.001:1 to 0.002:1; and
B/F may be in the range 0.008:1 to 0.50:1, e.g. 0.01:1 to 0.15:1 or 0.02:1 to 0.07:1.

The electrolyte composition may be prepared by first forming the buffer system and then adding the aluminium as a soluble salt and the formate ions as formic acid. The pH is adjusted to about 3.5. The noble metal salt is added as a solid and the soluble base metal salt then added as a solid. The mixture is stirred until all the components are dissolved. The pH is then adjusted to 4–6 and the volume made up with demineralized or distilled water.

The invention extends to a process of forming electrodeposits which comprises immersing a work piece having a conducting surface as the cathode in the said electrolyte composition and passing a suitable electrolysing current through the bath from a suitable anode to the said cathode through the electrolyte. The anode may be a soluble gold anode, or an insoluble, platinum, platinized titanium stainless steel or carbon anode.

The ratio of the surface area of the anode to the surface area of the cathode is preferably at least 1:1 e.g. 2:1 to 5:1 or higher. Current densities of 1 to 100 amps per square foot (0.1 to 10 amps/dm$^2$) can be used but current densities of 5 to 15 amps/square foot are preferred.

The bath can be used for barrel plating or for rack or other still plating but in this case the electrolyte is preferably agitated.

The temperature of the plating bath during plating is preferably in the range 10° to 70° C e.g. 20° to 40° C. The electrolysing current is preferably substantially ripple free smoothed current. However the plating electrolyte of this invention gives electrodeposits of excellent quality even with supplies which are not completely smoothed. This is a considerable advantage over some conventional acid gold cyanide plating baths.

The components (a), (b), (c), (d) and (e) of the electrolyte can be supplied to the user in various combinations. It will be appreciated that the soluble noble metal salt component (a) is the most suitable component and conventionally it is supplied as a solution separate from the remaining ingredients of plating baths.

A combination of component (a) and component (d) (the aluminium solution) is a novel composition of matter and these ingredients are compatible. A combination of components (a) and (e) would also be novel but would be liable to deposit gold formate unless the pH was carefully adjusted.

Combinations of components (b) and (d) or (b) and (e) or (b), (d) and (e) each with the optional presence of (c) would also be novel and useful.

Clearly these solutions could be supplied at the actual concentrations required for the plating bath or with the components in the correct proportions but at higher concentrations so that they would merely require dilution before use.

The invention thus extends to the novel combinations of components as solutions.

The deposit which is formed is a hard smooth deposit which emerges in a bright state from the plating bath. It contains from 0.05 to 0.3% of base metal, e.g. cobalt, codeposited with the noble metal, e.g. gold. The deposit has excellent wear resistance withstanding at least 1000 cycles on the wear test described below despite being softer than some gold cobalt codeposits from cyanide baths.

The invention thus extends to the deposits when made by the process of the invention.

The invention may be put into practice in various ways and a number of specific examples will be given to illustrate the invention and a control example will be given by way of comparison.

EXAMPLES 1 TO 30

Example 1 is a control example. Examples 2 to 6 illustrate the use of aluminium without formic acid. Examples 7, 13, 19 and 25 illustrate the use of formic acid without aluminium. Table 1 below gives the proportions of aluminium and formic acid used in each example together with the specific plating rate (sometimes referred to as electrolytic efficiency) and the hardness of the deposit.

For each example 1 liter of solution was made up as follows:

A weighed amount (that given in Table 1) of aluminium metal was dissolved in aqueous concentrated potassium hydroxide (for example when 1 gram of aluminium was used it was dissolved in about 50 ml of potassium hydroxide) at room temperature and then filtered to remove a black residue which was discarded.

50 grams of citric acid and 135 grams of tripotassium citrate were dissolved in demineralized water at room temperature. The potassium aluminate was then added to the buffer solution and then the formic acid was added again at room temperature. Potassium hydroxide was then added to bring the pH to just over 3.5. 11.9 Grams of potassium aurocyanide (providing 8 grams per liter of gold) was then added followed by 7.5 grams of cobalt sulphate. $7H_2O$ (providing 1.5 grams per liter of cobalt). The solution was then stirred to dissolve these solids. The solution volume at this point was about 600 mls. The pH was adjusted to 4.9 to 5.0 by addition of potassium hydroxide and demineralized water added to bring the volume up to 1 liter.

EXAMPLES 31, 32 AND 33

In these examples the solution was made up in the same way with 16, 24 and 32 grams per liter of gold respectively.

TABLE 1

| Example | Aluminium g.p.l. | Formic Acid ml. p.l | Hardness | SPR |
|---|---|---|---|---|
| 1 | 0 | 0 | 150 | 58.5 |
| 2 | 0.05 | 0 | 146 | 56.3 |
| 3 | 0.10 | 0 | 140 | 60.3 |
| 4 | 0.20 | 0 | 127 | 63.5 |
| 5 | 0.50 | 0 | 130 | 69.3 |
| 6 | 1.00 | 0 | 150 | 67.5 |
| 7 | 0 | 10 | 132 | 68.1 |
| 8 | 0.05 | 10 | 122 | 70.1 |
| 9 | 0.10 | 10 | 125 | 73.2 |
| 10 | 0.20 | 10 | 112 | 75.4 |
| 11 | 0.50 | 10 | 120 | 77.7 |
| 12 | 1.00 | 10 | 123 | 77.5 |
| 13 | 0 | 20 | 120 | 84.5 |
| 14 | 0.05 | 20 | 107 | 85.8 |
| 15 | 0.10 | 20 | 110 | 85.3 |
| 16 | 0.20 | 20 | 112 | 87.0 |
| 17 | 0.50 | 20 | 112 | 82.7 |
| 18 | 1.00 | 20 | 114 | 85.4 |
| 19 | 0 | 50 | 120 | 79.2 |
| 20 | 0.05 | 50 | 118 | 79.2 |
| 21 | 0.10 | 50 | 117 | 70.5 |
| 22 | 0.20 | 50 | 109 | 80.6 |
| 23 | 0.50 | 50 | 109 | 80.8 |
| 24 | 1.00 | 50 | 111 | 77.9 |
| 25 | 0 | 100 | 124 | 68.2 |
| 26 | 0.05 | 100 | 122 | 71.6 |
| 27 | 0.10 | 100 | 114 | 72.0 |
| 28 | 0.20 | 100 | 139 | 80.3 |
| 29 | 0.50 | 100 | 130 | 72.4 |
| 30 | 1.00 | 100 | 132 | 77.0 |
| 31 | 0.20 | 20 | | |
| 32 | 0.20 | 20 | | |
| 33 | 0.20 | 20 | | |

1 Inch by 1 inch square polished brass panels were plated with these solutions. The panels were cleaned as follows prior to plating:

1. immerse in hot alkaline soak cleaner, rinse in cold water,
2. cathodic electrolytic cleaning, rinse in cold water,
3. dip in dilute sulphuric acid, rinse in cold water,
4. bright nickel flash (brief electrolytic coating in nickel solution), rinse in cold water,
5. remove oxide film by immersing in nickel activator, rinse in cold water,
6. dip in dilute sulphuric acid, rinse in cold water,
7. gold strike (short plating cycle 10–15 seconds in very dilute gold solution), rinse in cold water.

The panels were then dried and weighed. The panels were plated in series with a copper coulometer, i.e. 2 panels were plated simultaneously, one the test panel in the gold electrolyte, the other, a control, in a copper electrolyte which plates with 100% efficiency.

The temperature during plating was 35° C and the current density was 10 amps per square foot. The bath was agitated. A single phase D.C. supply was used without smoothing. (A smoothed supply is preferable but not essential for this electrolyte). The plating time was 1 hour. The plating thickness was of the order of 20–30 microns.

The specific plating rate (SPR) was determined from the equation:

$$\text{SPR} = \frac{\text{weight of gold deposited}}{\text{weight of copper deposited}} \times 19.77,$$

and is quoted in Table 1 in milligrams per ampere minute. The hardness of the gold deposit was then measured with a Vickers micro-hardness gauge with a microscope attachment using a 10 gram load. All the samples were satisfactorily bright.

EXAMPLE 34

Example 16 was repeated but the substrate was a copper clad epoxy glass laminate printed circuit board which was plated to 5 microns thickness on the wearing face. The contacts of a connector were plated to 5 microns thickness in a sulphite gold plating bath. The plating conditions for the board were pH 4.9–5.0, temperature 35° C, current density 10 amps per square foot, time 16 times.

The solutions were agitated by a circulating pump and filtered using a 5 micron cotton filter. The solution was recycled about 4 times per hour. The anode area was in excess of 4 times the area of the cathode. The anode was a platinized coated titanium mesh.

The circuit board was then inserted into and removed from the connector at a rate of not more than 13 insertions per minute and the board tested after every 50 insertions. The test assembly was provided with guides to ensure that the contacts tracked along the same paths the whole time. The test was to determine whether there was penetration through the gold layer to the underlying base metal substrate. The sample is exposed to sulphur dioxide gas. This will corrode the substrate if there is any penetration. The sample is then exposed to hydrogen sulphide gas and any penetration is indicated by discolouration (black) visible to the unaided eye in normal daylight.

The same connector structure and board thickness was used for all tests.

The deposit of Example 34 survived over 1000 insertions.

EXAMPLES 35 TO 37

Example 34 was repeated at pHs of 4.3, 4.7 and 5.4 and produced deposits of similar excellent wear resistance, all surviving over 1000 insertions. At pH 5.4 the brightness is less good.

The wear resistance of a circuit board made as in Example 34 but using the Example 1 electrolyte was also of the order of 1000 cycles but as can be seen from Table 1 the specific plating rate for this formulation is only 58.5%.

As can be seen from Examples 7, 13, 17 and 25, the presence of formic acid in the absence of aluminium significantly improves the specific plating rate. Hull cell tests indicate that in addition the presence of formic acid enhances the appearance of the deposit over a wide range of current density.

As can be seen from Table 1 Examples 2 to 6 indicate that aluminium in the absence of formic acid has a slight effect on specific plating rate. Hull cell tests however indicate that in addition the presence of aluminium markedly improves the appearance of the deposit to a degree significantly in excess of that achieved by formic acid on its own.

Comparison of Example 16 with Examples 13 and 4 indicates that the presence of aluminium and formic acid together produces better results than are achieved by the system containing only one of the two components at the same concentration.

Comparison of Example 8 with Examples 2 and 7; 15 with 3 and 13; 22 with 4 and 19; 29 with 5 and 25 and 30 with 6 and 25 give supporting evidence of their synergistic effect.

The specific plating rates of Examples 8, 15, 16, 22, 29 and 30 are 70.1, 85.3, 87.0, 80.6, 72.4 and 77.0 indicating a peak intermediate the limits and indicating that by the time the aluminium level is 1.00 g.p.l. and the formic acid level is 100 cc per liter the effect is falling away although the results are still better than Example 1 where neither component is present.

Table 2 below gives the values of the ratios N/B, N/A, B/A, N/F, A/F and B/F for Examples 1 to 33.

TABLE 2

| Example | Aluminium g.p.l. | Formic Acid ml.p.l. | N | B | A | F | N/B | N/A | B/A | N/F | A/F | B/F |
|---|---|---|---|---|---|---|---|---|---|---|---|---|
| 1 | 0 | 0 | 0.04 | 0.025 | | | 1.6 | — | — | — | — | — |
| 2 | 0.05 | 0 | | | 0.0019 | — | 1.6 | 21.1 | 13.2 | — | — | — |
| 3 | 0.10 | 0 | | | 0.0037 | — | 1.6 | 10.8 | 6.8 | | | |
| 4 | 0.20 | 0 | | | 0.0074 | — | 1.6 | 5.4 | 3.4 | | | |
| 5 | 0.50 | 0 | | | 0.019 | — | 1.6 | 2.1 | 1.3 | | | |
| 6 | 1.00 | 0 | | | 0.037 | — | 1.6 | 1.1 | 0.68 | | | |
| 7 | 0 | 10 | | | | | 1.6 | — | — | — | — | — |
| 8 | 0.05 | 10 | 0.04 | 0.025 | 0.0019 | 0.26 | 1.6 | 21.1 | 13.2 | 0.15 | .0073 | 0.10 |
| 9 | 0.10 | 10 | | | 0.0037 | 0.26 | 1.6 | 10.8 | 6.8 | 0.15 | .014 | 0.10 |
| 10 | 0.20 | 10 | | | 0.0074 | 0.26 | 1.6 | 5.4 | 3.4 | 0.15 | .028 | 0.10 |

TABLE 2-continued

| Example | Aluminium g.p.l. | Formic Acid ml.p.l. | N | B | A | F | N/B | N/A | B/A | N/F | A/F | B/F |
|---|---|---|---|---|---|---|---|---|---|---|---|---|
| 11 | 0.50 | 10 | | | 0.019 | 0.26 | 1.6 | 2.1 | 1.3 | 0.15 | .073 | 0.10 |
| 12 | 1.00 | 10 | | | 0.037 | 0.26 | 1.6 | 1.1 | 0.68 | 0.15 | 0.14 | 0.10 |
| 13 | 0 | 20 | | | | | 1.6 | — | — | — | — | — |
| 14 | 0.05 | 20 | 0.04 | 0.025 | 0.0019 | 0.54 | 1.6 | 21.1 | 13.2 | 0.074 | 0.0035 | 0.05 |
| 15 | 0.10 | 20 | | | 0.0037 | 0.54 | 1.6 | 10.8 | 6.8 | 0.074 | 0.0070 | 0.05 |
| 16 | 0.20 | 20 | | | 0.0074 | 0.54 | 1.6 | 5.4 | 3.4 | 0.074 | 0.014 | 0.05 |
| 17 | 0.50 | 20 | | | 0.019 | 0.54 | 1.6 | 2.1 | 1.3 | 0.074 | 0.035 | 0.05 |
| 18 | 1.00 | 20 | | | 0.037 | 0.54 | 1.6 | 1.1 | 0.68 | 0.074 | 0.070 | 0.05 |
| 19 | 0 | 50 | | | | | 1.6 | — | — | — | — | — |
| 20 | 0.05 | 50 | 0.04 | 0.025 | 0.0019 | 1.33 | 1.6 | 21.1 | 13.2 | 0.030 | 0.0014 | 0.019 |
| 21 | 0.10 | 50 | | | 0.0037 | 1.33 | 1.6 | 10.8 | 6.8 | 0.030 | 0.0028 | 0.019 |
| 22 | 0.20 | 50 | | | 0.0074 | 1.33 | 1.6 | 5.4 | 3.4 | 0.030 | 0.0056 | 0.019 |
| 23 | 0.50 | 50 | | | 0.019 | 1.33 | 1.6 | 2.1 | 1.3 | 0.030 | 0.014 | 0.019 |
| 24 | 1.00 | 50 | | | 0.037 | 1.33 | 1.6 | 1.1 | 0.68 | 0.030 | 0.0028 | 0.019 |
| 25 | 0 | 100 | | | | | 1.6 | | | | | |
| 26 | 0.05 | 100 | .04 | .025 | .0019 | 2.65 | 1.6 | 21.1 | 13.2 | .015 | .0071 | .009 |
| 27 | 0.10 | 100 | | | .0037 | 2.65 | 1.6 | 10.8 | 6.8 | .015 | .0014 | .009 |
| 28 | 0.20 | 100 | | | .0074 | 2.65 | 1.6 | 5.4 | 3.4 | .015 | .0028 | .009 |
| 29 | 0.50 | 100 | | | .019 | 2.65 | 1.6 | 2.1 | 1.3 | .015 | .0071 | .009 |
| 30 | 1.00 | 100 | | | .037 | 2.65 | 1.6 | 1.1 | 0.68 | .015 | .014 | .009 |
| 31 | 0.20 | 20 | 0.08 | 0.25 | 0.0074 | 0.54 | 3.2 | 10.8 | 3.4 | 0.030 | 0.014 | 0.05 |
| 32 | 0.20 | 20 | 0.12 | 0.25 | 0.0074 | 0.54 | 4.8 | 16.2 | 3.4 | 0.045 | 0.014 | 0.05 |
| 33 | 0.20 | 20 | 0.16 | 0.25 | 0.0074 | 0.54 | 6.4 | 21.6 | 3.4 | 0.060 | 0.014 | 0.05 |

We have tried tungsten, indium, cadmium, nickel and iron as replacements for aluminium at concentrations in the range specified but they do not produce a comparable increase in specific plating rate and brightness.

We have tried sulphamic glycollic and oxalic acids as replacements for formic acid. Sulphamic acid and glycollic at comparable concentrations do not produce a comparable increase in brightness or specific plating rate.

Oxalic acid improves brightness and specific plating rate both at low pH e.g. 4.3 to 4.6 and at higher pH e.g. 4.7 to 5.0. Over a pH range of 4.5 to 5.2, baths containing citric acid, citrate, cobalt and formic acid show much better buffering characteristics than baths in which the formic acid is replaced by oxalic acid. This is a significant advantage for formic acid because at these higher pHs the specific plating rate is also higher.

With a gold concentration of 16 grams per liter and oxalic acid in the solution additions had to be made to the solution to adjust the pH when only 0.5 grams of gold had been deposited whilst with formic acid in the solutions the pH did not need adjusting until 5 grams of gold had been plated out (though clearly gold replenishments were added).

Acetates and tartrates should not be used as buffers because they cause problems of precipitation and instability in the solution.

We prefer cobalt to nickel as the brightener because it produces a given increase in brightness and specific plating rate at about half the concentration required for nickel. Nickel is in any case a less effective brightener at the pHs at which it is preferred to work. Iron is a more efficient brightener than cobalt, but it does not give such an increase in specific plating rate in the formic acid/citrate system. Iron also embrittles the deposit, with the risk of spontaneous cracking at thicknesses of 1 to 5 microns, when used in sufficient amounts to brighten the deposit noticeably. However, the amount of cracking produced in this way has consistently proved to be less than would be expected in an acid gold deposit of this type, and we consider that an advantage of the formic acid/citrate system is its tolerance to iron contamination.

What we claim as our invention and desire to secure by Letters Patent is:

1. An aqueous electrolyte solution for use in the electrodeposition of gold which comprises gold in the form of a soluble salt at a concentration of 1 to 32 grams per liter of gold, a base metal selected from the group consisting of cobalt and nickel in the form of a soluble salt at a concentration of 0.1 to 20 grams per liter of base metal, a compatible buffer system effective to produce a pH of 4 to 6 and a density of 1° to 32° Baume, aluminium in the form of a soluble salt at a concentration of 0.01 to 2 grams per liter, and formate or oxalate ions at a concentration of 1 to 250 grams per liter.

2. A solution as claimed in claim 1 in which the soluble gold salt is an ammonium salt.

3. A solution as claimed in claim 1 in which the soluble gold salt is an alkali metal aurocyanide.

4. A solution as claimed in claim 1 in which the base metal salt is cobalt sulphate.

5. A solution as claimed in claim 1 in which the buffer system is a citric acid/citrate buffer.

6. A solution as claimed in claim 5 in which the buffer system comprises 30 to 80 grams per liter of citric acid and 100 to 160 grams per liter of tripotassium citrate.

7. A solution as claimed in claim 1 in which the aluminium salt is an alkali metal aluminate.

8. A solution as claimed in claim 1 in which the aluminium is at a concentration of 0.15 to 0.30 grams per liter and the formic acid is at a concentration of 20 to 40 grams per liter.

9. A solution as claimed in claim 1 in which the ratio of noble metal (N) in gram atoms to base metal (B) in gram atoms is in the range 7.0:1 to 0.15:1; the ratio of noble metal (N) in gram atoms to aluminium (A) in gram atoms is in the range 30:1 to 1:1; the ratio of base metal (B) in gram atoms to aluminium (A) in gram atoms is in the range 35:1 to 0.5:1; the ratio of noble metal (N) in gram atoms to formate ions (F) in gram ions is in the range 0.01:1 to 0.2:1; the ratio of aluminium (A) in gram atoms to formate ions (F) in gram ions is in the range 0.0005:1 to 0.2:1; and the ratio of base metal (B) in gram atoms to formate ions (F) in gram ions is in the range 0.008:1 to 0.50:1.

10. A solution as claimed in claim 9 in which N/B is in the range 2:1 to 1:1, N/A is in the range 10:1 to 3:1, B/A is in the range 7:1 to 1:1, N/F is in the range 0.05:1 to 0.1:1, A/F is in the range 0.001:1 to 0.002:1 and B/F is in the range 0.01:1 to 0.15:1.

11. A method of making a solution as claimed in claim 1 in which the buffer system is formed first, the aluminium is then added as a soluble salt and the formate ions are then added as formic acid, the pH is adjusted to about 3.5, the soluble gold salt is added as a solid and the soluble base metal salt is added as a solid, the mixture stirred until all the components are dissolved, the pH adjusted to 4 to 6 and the volume made up with the demineralized or distilled water.

12. A process for forming a gold electro-deposit which comprises immersing a workpiece having a conductive surface as the cathode in an electrolyte solution as claimed in claim 1 and passing an electrolysing current through the electrolyte from an anode to the said cathode.

13. A process as claimed in claim 12 in which the ratio of the surface area of the anode to the surface area of the cathode is at least 1:1, the current density is in the range 1 to 100 amps per square foot and the temperature of the plating bath during plating is in the range 10° to 70° C.

14. A process as claimed in claim 12 in which the electrolyte solution contains 8 grams per liter of gold, 1.5 grams per liter of cobalt, 0.2 grams per liter of aluminium and 20 milliliters per liter of formic acid of density 1.22 g/l.

* * * * *